United States Patent [19]

Rowland

[11] 4,139,014

[45] Feb. 13, 1979

[54] COMBINATION HAIR STYLING/HAIR CURLING DEVICE

[76] Inventor: Willis O. Rowland, Rochdale Village Sta., P.O. Box 751, Jamaica, N.Y. 11434

[21] Appl. No.: 788,892

[22] Filed: Apr. 19, 1977

[51] Int. Cl.[2] ..... A45D 24/00

[52] U.S. Cl. ..... 132/11 A

[58] Field of Search ..... 132/9, 36, 11 R, 11 A, 132/37 R, 112, 117–118; 34/97, 243; 230/125; 219/370–371, 369

[56] References Cited

U.S. PATENT DOCUMENTS

| | | | |
|---|---|---|---|
| 381,983 | 5/1888 | Campbell | 132/137 |
| 1,217,454 | 2/1917 | Jacobs et al. | 132/117 |
| 3,476,121 | 11/1969 | Foley | 132/9 |
| 3,853,133 | 12/1974 | Komatsu | 132/11 A |
| 4,024,375 | 5/1977 | Olesen | 132/37 R |
| 4,032,747 | 6/1977 | Kunz | 132/37 R |

*Primary Examiner*—G.L. McNeill

[57] ABSTRACT

A styling comb/hair curler combination comprising a housing having a motor, heating element, and blower therein efficiently and compactly arranged to reciprocate the comb or alternatively, heat the curling attachment.

8 Claims, 9 Drawing Figures

FIG.1
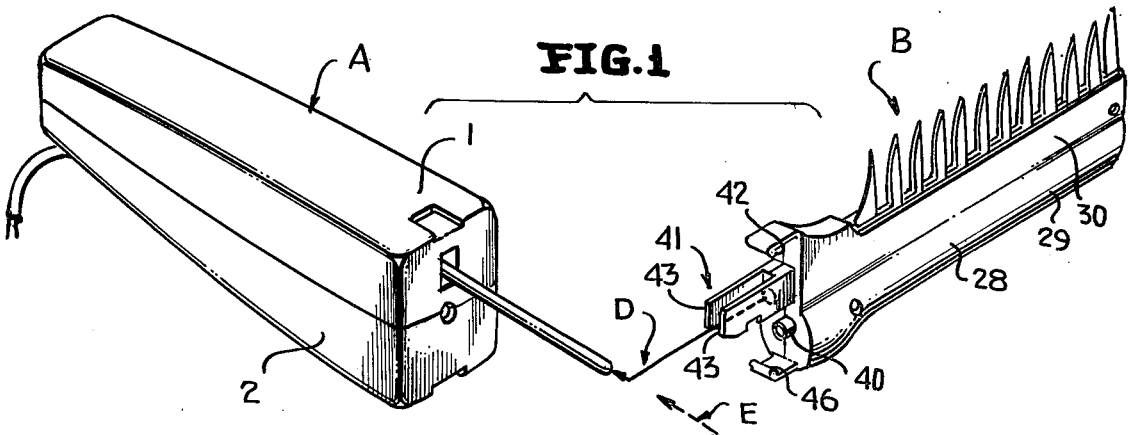
FIG.2
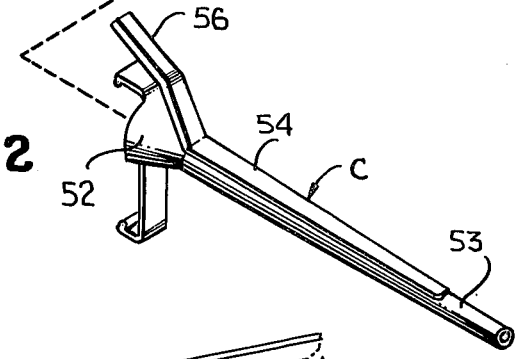
FIG.3
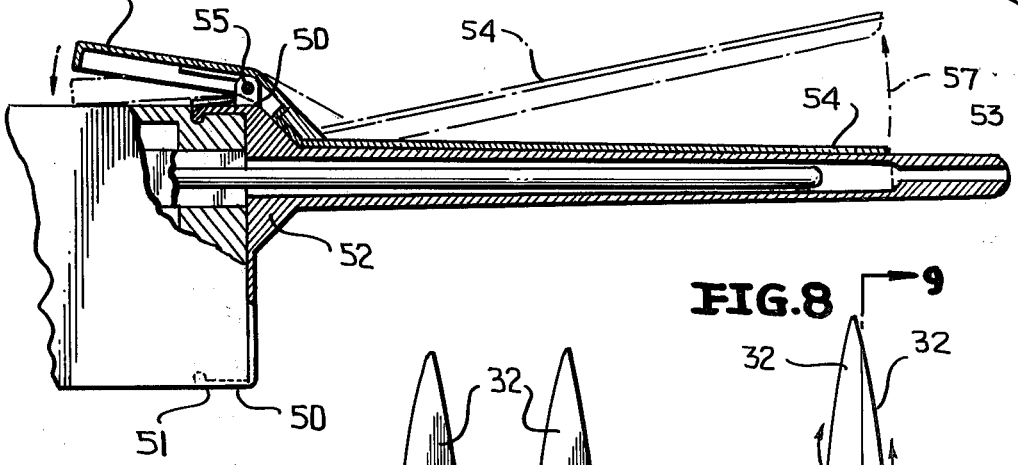
FIG.8
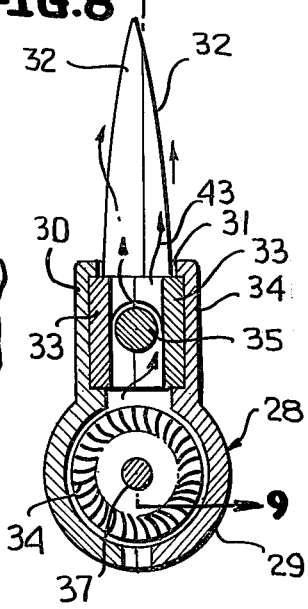
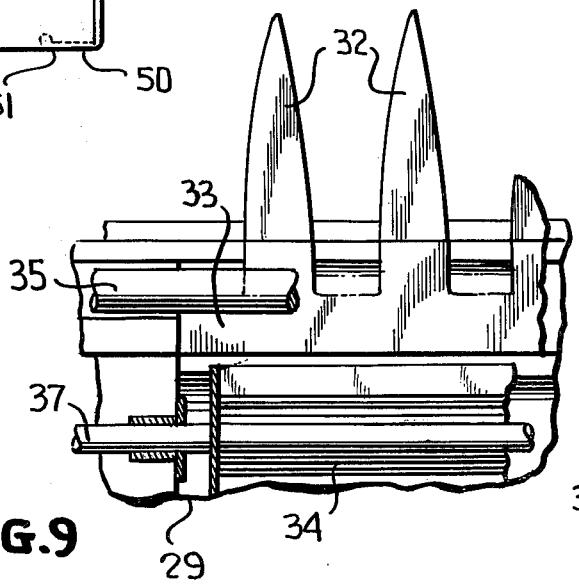
FIG.9

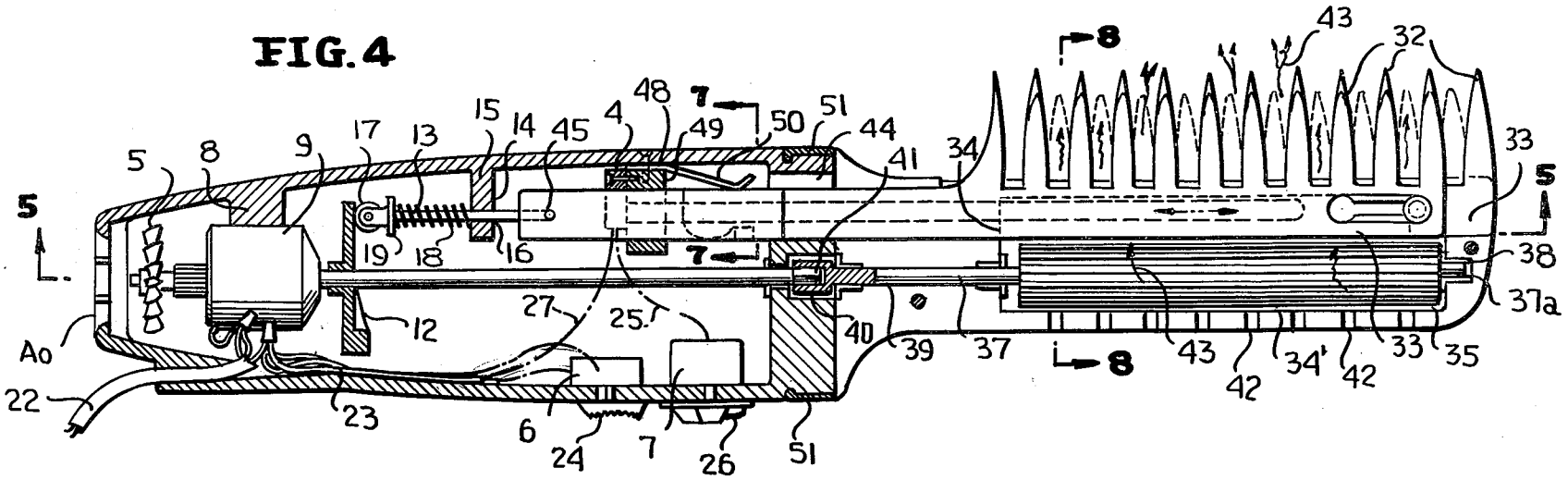
FIG.4
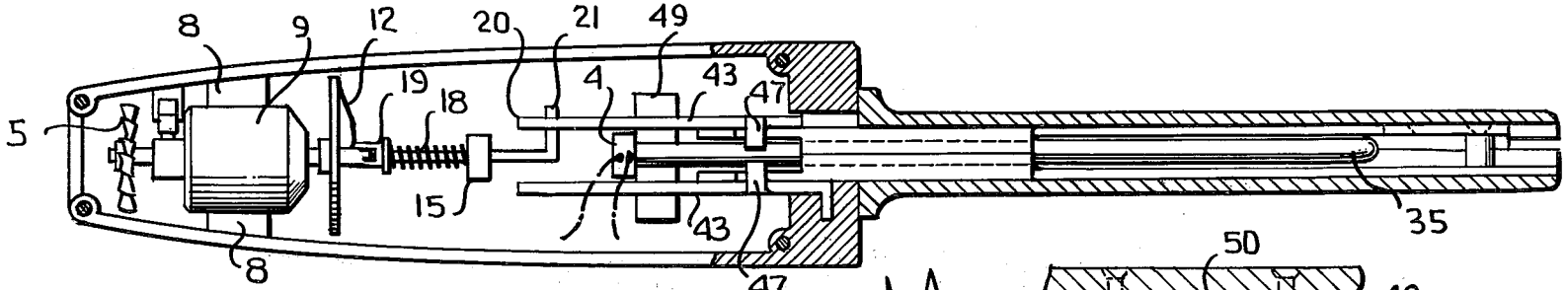
FIG.5
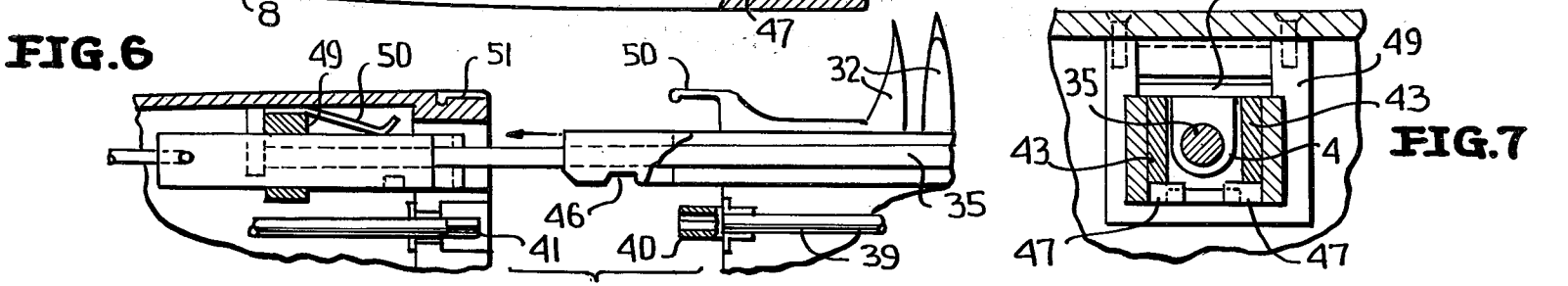
FIG.6
FIG.7

COMBINATION HAIR STYLING/HAIR CURLING DEVICE

BRIEF DESCRIPTION OF THE PRIOR ART

Hair styling combs and hair curlers are well known in the prior art and are commercially available.

These devices generally comprise a main housing having a heater, a blower and controls therefor disposed therein. A comb or curler attachment is readily received within the housing to be driven thereby in the case of the comb, and heated in the case of the curler.

SUMMARY OF THE INVENTION

The novelty of the present invention over the known devices is in its construction, arrangement and minimum number of parts, ease of assembly, and overall economical cost of the same.

To this end, the housing is comprised of two parts generally mirror images of one another which when mated together, provide a hollow interior having a drive motor, means driven by the motor, a heater, a blower and controls therefor disposed therein. A comb or curler attachment is readily received within the housing to be driven thereby in the case of the comb, and heated in the case of the curler.

The hair comb/curler can be used in various combinations with or without the heat which lends to its overall versatility, for example, the same can be used as a regular fine tooth or wide tooth comb depending on the setting thereof; it can be used as a hair dryer by removing the comb; it can be used as a detangler and hair straightener due to the use of metal combs.

When the curler attachment is utilized, the slanting construction thereof permits the same to be used with different length hair.

BRIEF DESCRIPTION OF THE DRAWING

FIG. 1 is an assembly view showing the handle and the attachments that can be removably secured thereto;

FIG. 2 shows the details of the curling iron;

FIG. 3 is a partial sectional view showing the manner in which the curling iron is attached to the handle;

FIG. 4 is a cutaway view illustrating the comb attached to the housing and the details of the drive associated therewith;

FIG. 5 is a longitudinal sectional view taken on line 5—5 of FIG. 4 showing further details of the attachment means and drive therefor;

FIG. 6 is a partial sectional view showing the manner in which the styling comb is inserted into the housing;

FIG. 7 is an end view showing the details of the mounting structure supporting the shaft housing and shaft of the comb disposed therein;

FIG. 8 is a sectional view showing the details of the comb and blower mechanism taken on line 8—8 of FIG. 1; and FIG. 9 is a partial sectional view showing the details of the blower mount with respect to the shaft of the styling comb.

DESCRIPTION OF THE PREFERRED EMBODIMENT

Referring to FIG. 1 of the drawing, the hair styling comb/curler of the present invention is seen to be comprised of a handle A, the styling comb B, and the curler C, with either of the latter being adapted to be connected to the housing A as seen by the arrows D, E.

As seen, the housing A is comprised of two parts 1, 2, generally mirror images of one another which when mated together provide a hollow interior having a drive motor 3, a heating element 4, a blower 5, and motor control and heat control means 6 and 7, respectively, mounted therein, all of which is clearly shown in FIG. 4. With continuing reference to FIG. 4, it is seen that the motor 3 is positioned between cooperating lugs 8, 8 extending inwardly to the interior of the housing to define a space 9 within which the motor is frictionally maintained. Extending from one end of the motor 3, is a first drive shaft 10, on which the fan 5 is rotatably disposed. The fan 5 is positioned adjacent the rear portion of the housing A within which an opening A0 is provided whereby atmospheric air can be drawn into the interior of the housing. Extending from the other end of the motor 3, is a drive shaft 11, which extends the entire length of the housing and terminates in the front wall thereof. A cam surface 12 is mounted on the shaft and rotates therewith to move a follower 13 positioned thereagainst. The follower 13 comprises a shaft 14 which is supported within the housing on a lug 15 having an opening 16 through which the shaft is inserted. One end of the shaft 13 supports a roller 17 which is spring biased by resilient means 18 into engagement with the cam surface 12 and is caused to move inwardly and outwardly in response thereto. Resilient means 18 has one end positioned against the lug 15 and the other against the mounting support 19 associated with a roller 17. At the other end of the shaft 14, an L-shaped member 20, is formed whereby the free end thereof 21, can be inserted in retaining fashion into an opening of the comb attachment B as will be explained hereinafter.

The motor 3 is provided with a cord 22 which passes through an opening $A_1$ in the housing A, and is provided with means, not shown, adapted to be inserted into a conventional electrical outlet. Additionally, the motor 3 is connected by lead 23 to the switch 6 having a finger grip 24 positioned exteriorly of the housing for selectively starting and stopping the same. As further seen in FIG. 4, the heating means 4 is electrically connected to heat control means 7 by lead 25 and is selectively heated in response to the turning of knob 26 associated therewith. Lead 27 interconnects the motor and blower control 6 and heating means 4 in order that the same may work in unison.

Referring back to FIG. 1, the styling comb B is seen to be comprised of a housing 28 having an arcuate lower portion 29 tapering upwardly into a longitudinal section 30. As seen in FIGS. 8 and 9, the longitudinal section 30 is provided with an elongated opening 31 through which the tines 32 of the comb extend. The tines 32 extend upwardly from a mounting member 33 respectively, which members are tightly encompassed between the walls 30 of the housing 28. The heat conducting shaft 4S is disposed between the supports 33 and is formed with a slight opening 35 disposed therearound to permit the same to reciprocate and thereby impart motion to the tines 32 in a manner to be explained hereinafter. The arcuate portion of the housing 29 encompasses a blower 34' comprised of a cylindrical member 35, having vane-type members 36 circumferentially disposed thereabout to cause air flow when the same is rotated. The blower 34' is mounted on a shaft 37 or alternatively, can be formed integrally therewith. The shaft 37 is provided with a stub end 37A positioned in recess 38 formed in the lower arcuate portion 29, and an elongated end 39 which terminates in an enlarged portion 40 having an opening 41, which receives the free end of shaft 11 to be driven thereby. The lower portion of the housing 29 is provided with spaced openings 42 through which air passes in response to rotation of the fan 34' and is conducted upwardly into, around and between the tines 32 as shown by the arrows 43 as seen in FIGS. 4 and 8. Extending rearwardly from the housing 28 of the styling comb B, is an attachment means 41' which is comprised of a U-shaped element having a base 42 secured to the end wall of the housing 28 and two spaced legs 43, 43 emanating therefrom. The legs 43 are resilient in nature and are adapted to be inserted into an opening 44 provided in the front wall of the housing A, in order that the same may be drivingly connected to the L-shaped member 21 referred to hereinabove.

As seen in FIG. 5, the legs 43 are disposed in the opening 44 and notches 46, 46 are disposed inwardly of the ends of the legs 43 and engage retaining members 47, 47, respectively, to lock the same within the housing A. Retaining members 47, 47 comprise inwardly extending lugs provided on spaced blade members 45, 45, one of which is provided with an opening 45' receiving the aformentioned L-shaped rod 21. As seen in FIG. 5, one of the blade members 45 is anchored at 45*a* in the front wall of the housing A, and together with the movable blade via the connection to 21 receives and restrains and guides the movement of the legs 43, 43 therebetween. An additional support member 48 spans and receives the blades 45, 45 in opening 49 to provide further support thereto. The heater 4 is also secured to the support 48 as is spring 50 bearing downwardly on legs 43, 43. A heat conducting shaft 4S extends from the heater 4 outwardly of the front of the housing A as seen in FIGS. 1 and 2 for conducting heat to the comb and curler.

The comb section of attachment B is comprised of two separate base members 33, 33 extending substantially the length of the housing 30 with each provided with a plurality of upstanding tines 32, 32 and joined together by a pin and slot connection PS whereby one of the bases and therefore the tines thereof, can reciprocate relative to one another in response to the oscillatory movement imparted thereto by the cam 12, follower 13 and connection of the blade 45 to the resilient legs 43.

FIG. 6 depicts the manner in which the styling comb is readily and easily received in the handle 1. With reference thereto, the user merely grabs the comb B, and aligns the shaft portion 39 with the end of the shaft 11 and the legs 43 with the opening 44 and forces the same into engagement whereby a connection is formed between the shaft 11 and the enlarged opening 41 and the retention members 47, 47 engage the notches 46, 46, respectively, to lock one to the other. Additionally, an annular flange 50*a* is provided on the housing 28 and seats within a recess 51*a* to further lock the comb B to the housing A.

If and when desired, the hairstyling comb B, can be removed by reversing the above procedure, and the curling iron inserted in its place. As seen in FIGS. 1, 2 and 3, the curling iron C is comprised of a funnel shaped base 52 having a tapered elongated cylindrical member 53 extending outwardly therefrom, and a hair retention means 54 pivotally disposed at 55 to the base 52. The hair retention means 54 is comprised of a segmental, elongated arcuate portion which cooperates with the exterior portion 53 to hold a lock of hair in place when wrapped therearound and a finger engaging means 56 is provided rearwardly of the pivot 55 for moving the hair retention means 54 toward and away from the body 53, as shown by the arrow 57. The base 52 is also provided with retention tabs 50 which cooperate with the recesses 51 in the same fashion as described hereinabove for locking the curler attachment C to the housing A. When the curler is secured in place, the heat conducting shaft 4S radiates heat to the curler body 53.

What I claim is:

1. A combination hair styling/curler combination comprising a housing, a source of heat positioned in the housing, a comb attachment or curler attachment adapted to be removably secured to the housing, a heating rod connected to said source of heat and extending outwardly of said housing, said rod being adapted to be extended into either the comb attachment or the curler attachment to provide a source of heat thereto, said comb attachment being comprised of a housing having a lower portion, rotatable fan means disposed therein and an upper portion receiving a pair of individual combs therein, means connecting said individual combs for reciprocatory movement with respect to each other, and means in said first mentioned housing driving said fan and said individual combs.

2. The combination of claim 1 wherein the lower portion of said hair attachment is provided with at least one opening for drawing air therein.

3. The combination of claim 1 wherein the first mentioned housing is provided with controls for regulating the said motor and said source of heat.

4. The combination of claim 1 wherein the curler attachment comprises an elongated housing having a substantially centrally disposed opening to receive said heating rod therein and a hair retainer movably mounted with respect to a portion of said elongated housing.

5. The combination of claim 3 wherein said motor has a shaft extending therefrom adapted to be coupled with said fan and a cam surface means disposed on said shaft having a follower associated therewith for reciprocating said comb.

6. The combination of claim 4 wherein said elongated housing is tapered from one end to the other.

7. The combination of claim 6 wherein said motor means drives a fan within the housing for drawing additional air therethrough.

8. The combination of claim 7 connecting means between the comb attachment and said housing includes spaced arms thereon adapted to be received in said housing wherein the same are provided with recesses to receive stop means provided in said housing.

* * * * *